US006439318B1

(12) United States Patent
Eddison et al.

(10) Patent No.: US 6,439,318 B1
(45) Date of Patent: Aug. 27, 2002

(54) DOWNHOLE APPARATUS

(75) Inventors: Alan Martyn Eddison, Stonehaven; Charles Abernethy Anderson, Banchory-Devenick, both of (GB)

(73) Assignee: Andergauge Limited, Aberdeen (GB)

( * ) Notice: Subject to any disclaimer, the term of this patent is extended or adjusted under 35 U.S.C. 154(b) by 0 days.

(21) Appl. No.: 09/582,568

(22) PCT Filed: Apr. 22, 1998

(86) PCT No.: PCT/GB98/01170

§ 371 (c)(1),
(2), (4) Date: Jun. 27, 2000

(87) PCT Pub. No.: WO98/48141

PCT Pub. Date: Oct. 29, 1998

(30) Foreign Application Priority Data

Apr. 24, 1997 (GB) ..... 9708294

(51) Int. Cl.[7] ..... E21B 1/12

(52) U.S. Cl. ..... 175/57; 175/322; 175/296; 173/91

(58) Field of Search ..... 175/57, 321, 322, 175/293, 296, 297, 305; 173/73, 91

(56) References Cited

U.S. PATENT DOCUMENTS

| | | | | |
|---|---|---|---|---|
| 2,743,083 A | | 4/1956 | Zublin | |
| 2,746,721 A | | 5/1956 | Moore | |
| 2,780,438 A | | 2/1957 | Bielstein | |
| 3,640,351 A | * | 2/1972 | Coyne et al. | 173/105 |
| 3,894,818 A | * | 7/1975 | Tschirky | 418/48 |
| 3,899,033 A | * | 8/1975 | Van Huisen | 175/97 |
| 3,933,209 A | * | 1/1976 | Sweeney | 173/80 |
| 3,941,196 A | * | 3/1976 | Currington et al. | 175/100 |
| 4,817,739 A | | 4/1989 | Jeter | |
| 4,819,745 A | | 4/1989 | Walter | |
| 4,830,122 A | | 5/1989 | Walter | |
| 4,979,577 A | | 12/1990 | Walter | |
| 5,009,272 A | | 4/1991 | Walter | |
| 5,190,114 A | | 3/1993 | Walter | |
| 5,662,180 A | * | 9/1997 | Coffman et al. | 175/57 |

* cited by examiner

*Primary Examiner*—Frank Tsay
(74) *Attorney, Agent, or Firm*—Alston & Bird LLP

(57) ABSTRACT

A downhole drilling assembly (10) comprises a body (11) for mounting on a drillstring, the body defining a fluid conduit. A drilling fluid driven motor (12) is mounted in the body (11) and is coupled to a flow restricting device (14) axially movably mounted to the body (11). The device is coupled to a drill bit (16). In use, the flow restricting device (14) is driven by the motor (12) to vary the flow of drilling fluid through the body and produce a varying fluid pressure force to induce axial movement of the device (14) relative to the body (11), and thus provide a percussive or hammer drilling effect. The flow restricting device (14) may be coupled to the drill bit (16) by a mandrel (46) splined or otherwise coupled to the body. Alternatively, the flow restricting device (68) may be coupled to the drill bit (72) by a rotatable shaft (70), such that the motor (64) may also rotate the drill bit (72).

18 Claims, 2 Drawing Sheets

DOWNHOLE APPARATUS

BACKGROUND OF THE INVENTION

1. Field of the Invention

This invention relates to downhole apparatus. In particular, but not exclusively, the invention relates to percussive drilling apparatus and a percussive drilling method.

In drilling operations in the oil and gas exploration and extraction industries drilling fluid or "mud" is pumped from the surface through the drillstring to exit from nozzles provided on the drill bit. The flow of fluid from the nozzles assists in dislodging and clearing material from the cutting face and serves to carry the dislodged material through the drill bore to the surface. It has been recognised that providing a pulsing fluid flow from the nozzles may also serve to increase the drilling rate. Further, it is well known that providing a percussive or hammer effect tends to increase the drilling rate.

2. Description of Related Art

Apparatus utilising one or both of these principles is described in U.S. Pat. No. 2,743,083 to Zublin, U.S. Pat. No. 2,780,438 to Bielstein, and U.S. Pat. Nos. 4,819,745, 4,830,122, 4,979,577, 5,009,272 and 5,190,114 all to Walter. A pulsing fluid flow is achieved by periodically restricting the drilling fluid flow area through the apparatus, the restriction creating a pressure force which provides a percussive effect. Flow restriction may be achieved by a variety of means, including valves which rotate about the longitudinal axis of the string, valves which rotate about a transverse axis, axially reciprocating valves and flap valves. The valve members are driven or reciprocated using drilling fluid driven motors comprising turbines of various forms, or fluid pressure fluid forces created by the movement of the valve member in the flow of drilling fluid.

In the majority of the earlier proposals, the pressure force which provides the percussive effect acts through a shock sub mounted above or below the flow restricting valve and the valve motor. The cycling fluid pressure causes the shock sub to extend and retract. However, such arrangements tend to be bulky. The movable part of the assembly has a significant mass, such that there is considerable inertia to be overcome with each fluid pressure cycle.

It is among the objectives of embodiments of the present invention to provide percussive drilling apparatus which is of relatively simple construction and is lighter and more compact than existing arrangements, to provide for more effective and efficient drilling.

BRIEF SUMMARY OF THE INVENTION

According to a first aspect of the present invention there is provided a downhole drilling assembly comprising:

a body for mounting on a downhole string and defining a fluid conduit;

a drive motor mounted in the body;

a flow restricting device axially movably mounted to the body and for connection to a drill bit; and a coupling between the motor and the flow restricting device, the device being driveable by the motor to vary the flow of fluid through the body and produce a varying fluid pressure force to induce axial movement of the device relative to the body.

According to another aspect of the present invention there is provided a percussive drilling method comprising the steps:

mounting a drive motor in the body of a device mounted on a drill string;

mounting an axially moveable drilling fluid flow restricting device in the body and coupling the device to the drive motor;

coupling a drill bit to the device;

passing drilling fluid through the drill string and device; and driving the device with the motor to vary the flow of fluid through the device and produce a varying fluid pressure force above the device, the force inducing movement of the device and drill bit relative to the body.

Preferably, the flow restricting device is connected to a mandrel or shaft having means for mounting a drill bit thereon. A mandrel may be splined or otherwise coupled to the body. Alternatively, a shaft may be rotatable relative to the body, such that the motor may also rotate the drill bit, providing a drilling motor capable of percussive or hammer drilling. In a preferred embodiment, the mandrel or shaft is spring mounted in the body.

Preferably also, the flow restricting device comprises a portion which is rotatable relative to the body and a portion which is fixed against rotation. In embodiments where the motor is utilised to drive a drill bit both the drill bit and the motor may be connected to the rotatable portion, and in embodiments where the drill bit is not driven by the motor the bit may be connected to the fixed portion.

The flow restricting device may be in the form of hollow shaft defining flow ports, the shaft being rotatable relative to a lobed sleeve; in one embodiment fluid flows into the hollow shaft via the flow ports, and when the flow ports are located behind the lobes of the sleeve the flow of fluid into the shaft is restricted. Alternatively, the device may include first and second valve members each defining a respective axial flow opening and which openings are aligned to collectively define an open axial drilling flow port through the device, the first member being rotatable about a longitudinal axis of the body to vary the alignment of the openings and thus vary the open area of the port.

Preferably also, the drive motor is drilling fluid actuated, for example the motor may be a positive displacement motor or a turbine.

According to an additional aspect of the present invention there is provided a downhole drilling motor assembly comprising:

a body for mounting on a downhole string and defining a fluid conduit;

a drive motor mounted in the body;

a flow restricting device mounted in the body;

a drill bit; and transmission means for coupling the motor and the flow restricting device and for coupling the motor and the drill bit, the device being driveable by the motor to vary the flow of fluid through the body and produce a varying fluid pressure force on the drill bit.

According to a further additional aspect of the present invention there is provided a percussive drilling method comprising the steps:

mounting a drive motor in a drill string;

mounting a fluid flow restricting device in the string;

mounting a drill bit on the string;

coupling the device and the drill bit to the drive motor;

passing drilling fluid through the drill string and the device; and driving the device with the motor to vary the flow of fluid through the valve and produce a varying fluid pressure force to induce movement of the drill bit relative to the string.

According to a further aspect of the present invention there is provided a downhole tool comprising: a fluid transmitting body; a mandrel telescopically spring mounted in the body; and a flow restricting device mounted to the mandrel.

According to a still further aspect of the present invention there is provided a method of providing a cycling force in a drill string, the method comprising the steps of:

providing a downhole tool in the string, the tool comprising a fluid transmitting body, a mandrel telescopically spring mounted in the body and a flow restricting device mounted to the mandrel;

pumping fluid through the body; and varying the configuration of the flow restricting device in a cyclical manner to vary the flow through the device, whereby a cycling fluid pressure force acts on the device and mandrel.

Preferably, in use, an increase in the fluid pressure force acting on the flow restricting device tends to extend the mandrel from the body.

BRIEF DESCRIPTION OF THE DRAWINGS

These and other aspects of the present invention, will now be described, by way of example, with reference to the accompanying drawings, in which.

DETAILED DESCRIPTION OF THE INVENTION

Figure 1:
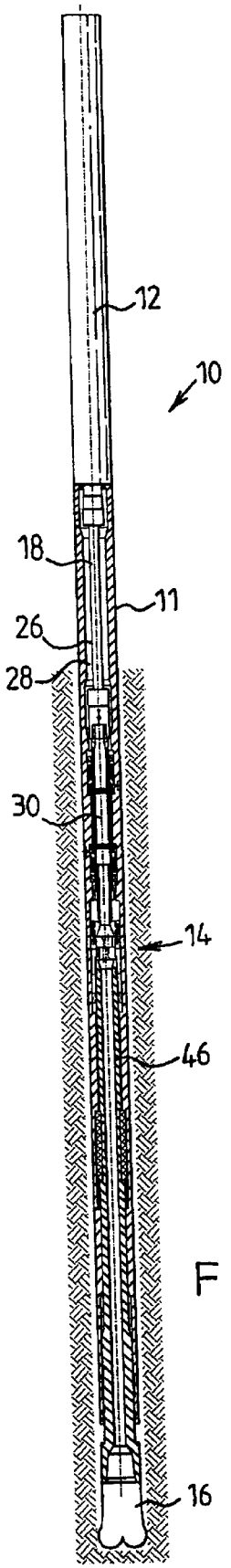
FIG. 1 is a part sectional view of a percussive drilling assembly in accordance with a first embodiment of the present invention.
Figure 2:
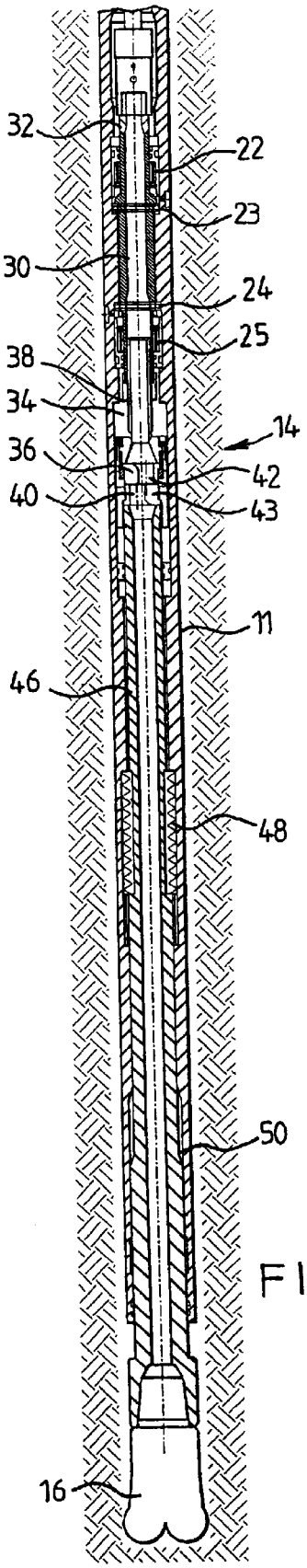
FIG. 2 is an enlarged view of the lower portion of the assembly of FIG. 1.

Reference is first made to FIGS. 1 and 2 of the drawings, which illustrates a percussive drilling assembly 10 in accordance with a first embodiment of the present invention. The assembly 10 is mounted on the lower end of a drillstring (not shown) and comprises a tubular elongate body 11, a positive displacement motor 12 and a flow restricting device 14 mounted in the body and a drill bit 16 extending from the lower end of the body.

The motor 12 operates on the Moineau principle and is driven by the drilling fluid which is pumped through the drillstring and the assembly 10 to the drill bit 16. A drive shaft 18 extends from the lower end of the motor 12 and is supported in the body 11 by bearings 22, 23, 24, 25. A solid shaft upper portion 26 is surrounded by an annulus 28 through which drilling fluid may flow. The upper portion 26 is connected to a shaft hollow portion 30 defining radial passages 32 so that the drilling fluid may flow from the annulus 28 into the hollow shaft 30.

The flow restricting device 14 is axially movable relative to the body 11 and is located within an annular chamber 34 in the body. The device 14 includes a rotatable upper valve plate 36 connected to the drive shaft 18 by a hollow shaft 38 which is telescopically received within the lower end of the shaft portion 30. The device 14 also includes a lower valve plate 40 which is fixed against rotation and located directly below the rotatable valve plate 36. The valve plates 36, 40 each define respective slots 42, 43. As the slots 42, 43 rotate into and out of alignment the flow of drilling fluid through the slots is restricted in a cyclic manner, creating a series of pressure pulses in the fluid. These pressure pulses are used to provide a percussive or hammer action, as will be described.

The fixed valve plate 40 is mounted on the upper end of a hollow mandrel 46 telescopically mounted within the lower end of the assembly body 11. Springs 48 act between the mandrel 46 and the body 11 and the mandrel 46 is splined 50 to prevent relative rotation between the mandrel 46 and the body 11. The drill bit 16 is mounted on the lower end of the mandrel.

In use, drilling fluid is pumped from the surface through the drillstring and the assembly 10. The passage of the fluid through the motor 12 causes the drive shaft 18 to rotate, and thus rotates the upper valve plate 36 relative to the lower plate 40. As mentioned above, this rotation moves the plate slots 42, 43 into and out of alignment, creating a series of pressure pulses in the drilling fluid. The pressure increases above the device 14 create downward fluid pressure forces on the device 14, urging the device 14 downward and extending the mandrel 46 from the body 11. These cyclic forces are transmitted directly to the drill bit 16, increasing the drill bit penetration rate. Further, the resulting fluctuations in drilling fluid flowrate at the bit 16 are more effective in cleaning cuttings away from the bit during drilling.

Figure 3:
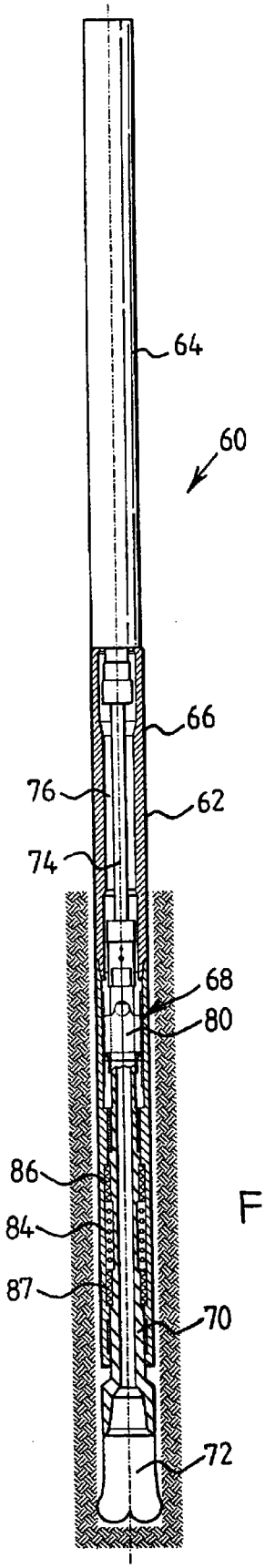
FIG. 3 is a part sectional view of a percussive drilling motor in accordance with a second embodiment of the present invention.

Reference is now made to FIG. 3 of the drawings, which illustrates a positive displacement drilling motor 60 in accordance with a second embodiment of the present invention. The motor 60 comprises a hollow elongate body 62 for mounting on the lower end of a drillstring (not shown). The body 62 accommodates a power section 64, a transmission section 66, a flow restricting device 68 and a hollow shaft 70 on which a drill bit 72 is mounted.

Figure 4:
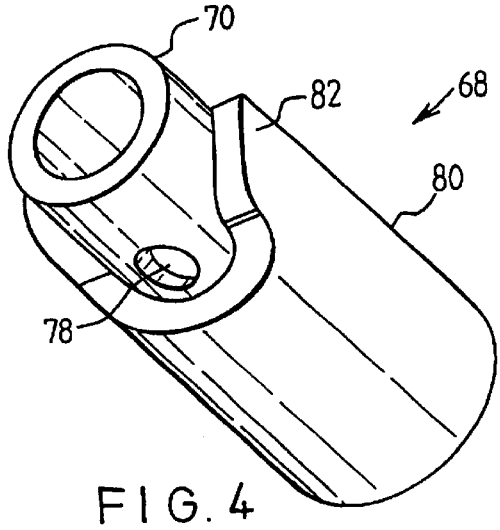
FIG. 4 is an enlarged perspective view of a flow restricting device of the motor of FIG. 3.

The transmission section 66 includes a solid shaft 74 located within an annulus 76 through which drilling fluid may flow. The lower end of the shaft 74 is coupled to the upper end of the hollow shaft 70. The upper end of the shaft 70 defines two transfer ports 78 (FIG. 4) and rotates within a lobed sleeve 80 fixed to the body 62 such that the ports 78 are covered and then uncovered by the sleeve lobes 82 as the shaft 70 rotates. With the transfer ports 78 positioned relative to the lobes 82 as illustrated in FIG. 4, drilling fluid is free to flow from the annulus 76 into the shaft 70. However, as the mandrel 70 rotates the ports 78 are covered by the lobes 82, restricting the flow of fluid. This flow restriction results in an increase in fluid pressure above the sleeve 80 and application of a downwardly directed pressure force on the shaft 70.

Thrust bearings 84 are provided between the shaft 70 and the body 60 to locate the shaft 70, however the bearings 84 are mounted between bellville springs 86, 87 to allow axial movement of the shaft 70 relative to the body 62.

In use, drilling fluid is pumped from the surface through the drillstring and through the drilling motor 60. Passing the fluid through the motor power section 64 results in rotation of the shafts 74, 70 and rotation of the drill bit 72. Further, rotation of the shaft 70 relative to the lobed sleeve 80 creates pressure pulses in the drilling fluid, with the increases in fluid pressure resulting in increasing fluid pressure forces on the shaft 70, which forces tend to urge the shaft 70, and the drill bit 72, downwardly relative to the body 62. The springs

86, 87 permit a degree of axial movement of the shaft 70 relative to the body 62, such that percussive or hammer action results at the drill bit 72.

It will be apparent to those of skill in the art that the above-described embodiments are less complex and more compact than existing percussion drilling assemblies, which include separate flow restrictors and shock subs. In these embodiments of the present invention only a single assembly is required, providing considerable cost savings. Further, robustness and reliability are enhanced. A further advantage of the embodiments of the invention is the reduction in mass of the elements of the assemblies which are subject to movement to provide the desired percussive or hammer effect. In conventional arrangements, the inertia of the movable portion is often such that the percussive effect that may be obtained is minimal.

It will also be clear to those of skill in the art that the above-described embodiments are merely exemplary of the present invention, and that various modifications and improvements may be made thereto without departing from the scope of the present invention. For example, in other embodiments a stabiliser may be mounted on the lower end of the body.

What is claimed is:

1. A downhole drilling assembly comprising:

a body for mounting on a downhole string and defining a fluid conduit;

a drive motor mounted in the body;

a flow restricting device axially movably mounted to the body and for connection to a drill bit; and a coupling between the motor and the flow restricting device, the device being driveable by the motor to vary the flow of fluid through the body and produce a varying fluid pressure force to induce axial movement of the device relative to the body.

2. The assembly of claim 1, wherein the flow restricting device is connected to a member having means for mounting a drill bit thereon.

3. The assembly of claim 2, wherein said member in the form of a mandrel which is splined to the body.

4. The assembly of claim 2, wherein said member is in the form of a shaft which is rotatable relative to the body.

5. The assembly of claim 2, wherein said member is spring mounted in the body.

6. The assembly of claim 1, wherein the flow restricting device comprises a first portion which is rotatable relative to the body and a second portion which is fixed against rotation.

7. The assembly of claim 6, wherein the motor is operable to drive the drill bit and the rotatable portion of the flow restricting device is connected to the motor and is connectable to the drill bit.

8. The assembly of claim 6, wherein the fixed portion of the flow restricting device is connectable to the drill bit.

9. The assembly of claim 1, further comprising a lobed sleeve and wherein the flow restricting device comprises a hollow shaft defining flow ports, the shaft being rotatable relative to the lobed sleeve.

10. The assembly of claim 9, wherein, in a first configuration, fluid may flow into the hollow shaft via the flow ports, and in a second configuration the flow ports are located behind the lobes of the sleeve and the flow of fluid into the shaft is restricted.

11. The assembly of claim 1, wherein the flow restricting device includes first and second valve members each defining a respective axial flow opening and which openings are aligned to collectively define an axial drilling flow port, with an open area, through the device, the first valve member being rotatable about a longitudinal axis of the body to vary the alignment of the openings and thus vary the open area of the port.

12. The assembly of claim 1, wherein the drive motor is drilling fluid actuated.

13. A percussive drilling method comprising the steps:

mounting a drive motor in the body of a device;

mounting an axially moveable drilling fluid flow restricting device in the body and coupling the device to the drive motor;

coupling a drill bit to the device;

mounting the device on a drill string;

running the string into a bore;

passing drilling fluid through the drill string and device; and driving the device with the motor to vary the flow of fluid through the device and produce a varying fluid pressure force above the device, the force inducing movement of the device and drill bit relative to the body.

14. A downhole drilling motor assembly comprising:

a body for mounting on a downhole string and defining a fluid conduit;

a drive motor mounted in the body;

a flow restricting device mounted in the body;

a drill bit; and transmission means for coupling the motor and the flow restricting device and for coupling the motor and the drill bit, the device being driveable by the motor to vary the flow of fluid through the body and produce a varying fluid pressure force on the drill bit.

15. A percussive drilling method comprising the steps:

mounting a drive motor in a drill string;

mounting a fluid flow restricting device in the string;

mounting a drill bit on the string;

coupling the device and the drill bit to the drive motor;

passing drilling fluid through the drill string and the device; and driving the device with the motor to vary the flow of fluid through the device and produce a varying fluid pressure force to induce movement of the drill bit relative to the string.

16. A method of providing a cycling force in a drill string, the method comprising the steps of:

providing a downhole tool in the string, the tool comprising a fluid transmitting body, a mandrel telescopically spring mounted in the body and a flow restricting device mounted to the mandrel;

pumping fluid through the body; and varying the configuration of the flow restricting device in a cyclical manner to vary the flow through the device, whereby a cycling fluid pressure actuating force acts on the device and mandrel and induces relative movement of the mandrel relative to the body.

17. A method of providing a cycling force in a drill string, the method comprising the steps of:

providing a downhole tool in the string, the tool comprising a fluid transmitting body, a mandrel telescopically spring mounted in the body and a flow restricting device mounted to the mandrel;

pumping fluid through the body; and varying the configuration of the flow restricting device in a cyclical manner to vary the flow through the device, whereby a cycling fluid pressure force acts on the device and mandrel.

18. The method of claim 17, wherein an increase in the fluid pressure force acting on the flow restricting device tends to extend the mandrel from the body.

* * * * *